US010772429B1

(12) United States Patent
Holbrook et al.

(10) Patent No.: US 10,772,429 B1
(45) Date of Patent: Sep. 15, 2020

(54) SLING ASSEMBLY

(71) Applicants: Richard Holbrook, Pasadena, CA (US); Darren Mark, Pasadena, CA (US)

(72) Inventors: Richard Holbrook, Pasadena, CA (US); Darren Mark, Pasadena, CA (US)

( * ) Notice: Subject to any disclaimer, the term of this patent is extended or adjusted under 35 U.S.C. 154(b) by 0 days.

(21) Appl. No.: 16/361,165

(22) Filed: Mar. 21, 2019

(51) Int. Cl.
*A47C 4/28* (2006.01)
*A47C 7/00* (2006.01)

(52) U.S. Cl.
CPC ..... *A47C 4/28* (2013.01); *A47C 7/002* (2013.01)

(58) Field of Classification Search
CPC ..... A47C 4/28; A47C 4/30; A47C 31/023; A47C 5/06; A47C 7/002
See application file for complete search history.

(56) References Cited

U.S. PATENT DOCUMENTS 3,137,372 A * 6/1964 Nash ..... A47C 31/04 403/206
3,273,877 A * 9/1966 Geller ..... B60N 2/72 267/89
3,604,073 A * 9/1971 Green ..... A47C 5/06 24/265 C
3,977,721 A * 8/1976 Peterson ..... A47C 4/283 297/45
4,252,367 A 2/1981 Vanderminden
4,359,809 A * 11/1982 Fraser ..... A47C 31/04 160/404
5,018,789 A 5/1991 Sheckells
5,318,348 A 6/1994 Hess
5,338,091 A * 8/1994 Miller ..... A47C 5/06 297/218.4
5,911,478 A 6/1999 Goodman
D429,424 S 8/2000 Vanderminden, Sr.
D452,082 S 12/2001 Pluer
(Continued)

OTHER PUBLICATIONS casualrefinishing.com, Feb. 27, 2019, Internet printout: http://casualrefinishing.com/Sling%20Install.html (13 pages).
(Continued)

*Primary Examiner* — Philip F Gabler
(74) *Attorney, Agent, or Firm* — Todd R. Miller

(57) ABSTRACT

A novel sling assembly and corresponding method of stretching sling fabric are disclosed. The assembly preferably comprises a chassis with opposing rails connected by a cross bar. A sling frame having opposing stretch bars connected by a stretchable fabric is disposed over the chassis in a pre-assembled position. A cam lock is inserted into a key hole cut into at least one of the rails; the cam lock is then rotated away from the central axis of the key hole. An engagement member extending from at least one of the stretch bars is then inserted into the key hole. The sling fabric may now be stretched by rotating the cam lock toward the central axis of the key hole to move the engagement member along the key hole until the fabric is taut. The taut fabric is held in place by the engaged cam lock, whereby the assembly is kept in its stretched, fully assembled position. The invention's unique structure thus advantageously makes sling fabric replacement convenient, quick, and without the need for special tools.

6 Claims, 12 Drawing Sheets

(56) References Cited

U.S. PATENT DOCUMENTS

| | | | | |
|---|---|---|---|---|
| 6,494,540 | B1 * | 12/2002 | Tornero | A47C 7/282 297/440.1 |
| 6,585,323 | B2 | 7/2003 | Gaylord | |
| 6,623,079 | B2 * | 9/2003 | Gregory | A47C 5/06 297/440.11 |
| 6,842,959 | B2 * | 1/2005 | Coffield | A47C 7/282 160/378 |
| 6,942,300 | B2 * | 9/2005 | Numa | A47C 7/282 297/218.3 |
| D549,481 | S | 8/2007 | Vanderminden | |
| D565,332 | S | 4/2008 | Erickson | |
| 7,367,629 | B2 * | 5/2008 | Kepler | A47C 7/14 297/218.5 |
| 7,731,291 | B2 * | 6/2010 | Wang | A47C 31/023 297/440.11 |
| 8,403,421 | B2 | 3/2013 | Wang | |
| 8,550,565 | B2 * | 10/2013 | Caldwell | A47C 7/16 297/452.63 |

OTHER PUBLICATIONS outdoorpatiosupplies.com, Instructions on How to Install One Piece Sling (8 pages).
homecrest.com, How to Install a Homecrest Replacement Sling (2 pages).
texacraft.com, Feb. 27, 2019, Internet printout: http://www.texacraft.com/sling-replacement-tc (2 pages).
patiofurniturerehab.com, Feb. 27, 2019, Internet printout: https://www.patiofurniturerehab.com/sling-replacements/sling-replacement-spearder-bar-tool (3 pages).

* cited by examiner

SLING ASSEMBLY

BACKGROUND

The present disclosure relates generally to comfortable and stylish furniture using stretchable fabric material.

SUMMARY

One exemplary embodiment of the disclosed subject matter is an assembly preferably comprising a chassis having a first rail and an opposing second rail connected by a cross bar disposed therebetween. The assembly also comprises a sling frame having a first stretch bar and an opposing second stretch bar connected by a stretchable fabric disposed therebetween. The first stretch bar has an engagement member extending therefrom. The first rail has a key hole cut therein configured to receive a cam lock and the engagement member. The cam lock is adapted to engage the engagement member to hold the fabric in a stretched, fully assembled position.

The cam lock preferably comprises a body having a cam extending therefrom, wherein the body has a keyway, and wherein the cam has a holder. The engagement member preferably comprises a leg and a glide base disposed at one end of the leg. The holder is configured to receive the glide base. The key hole preferably comprises a channel and a slot in communication therewith, wherein the leg of the engagement member is disposed within the slot when the assembly is in the stretched, fully assembled position.

Another exemplary embodiment of the disclosed subject matter is a method comprising inserting a cam lock into a key hole cut within a rail, wherein the key hole has a central axis. The cam lock is then rotated away from the central axis of the key hole. Next, an engagement member is preferably inserted into the key hole, wherein the engagement member extends from a first stretch bar of a sling frame. The sling frame includes the first stretch bar and an opposing second stretch bar connected by a stretchable fabric. The fabric is then stretched and held taut by rotating the cam lock back toward the central axis of the key hole to move the engagement member along the central axis of the key hole.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

Many people seek stylish and comfortable furniture. One such type is a sling chair or the like typically comprised of a support frame upon which stretchable fabric is mounted. As this chair is a joy to sit in, it is often the favorite of any user seeking to relax and perhaps enjoy a little sunshine and the great outdoors. Over time, however, sling fabric material tends to become worn, aged, or saggy.

At this stage in the game, the user must decide whether to replace the chair in its entirety or just replace the sling fabric. Should the latter route be in play, the user has a rather significant chore ahead.

To elaborate, while there are a few different styles of sling chairs, the most common configuration has the sling fabric seated into a channel in the rails of the chair's frame. To replace the sling fabric for this type of chair, a number of different steps must take place. Such steps may include disassembling the chair, cutting the new fabric to size, sewing hems, sewing sleeves, inserting the sling fabric in the rail's channels, reinserting the spreader bars of the chair, and reassembly. To reinsert the spreader bars, tools are available. Such spreader bar tools not only add to the cost of replacement but if used incorrectly could damage the frame or rivnuts (hidden nuts in the frame typically used in these applications).

Accordingly, a sling assembly that makes sling fabric replacement convenient, quick, and without the need for special tools is desired.

Figure 1:
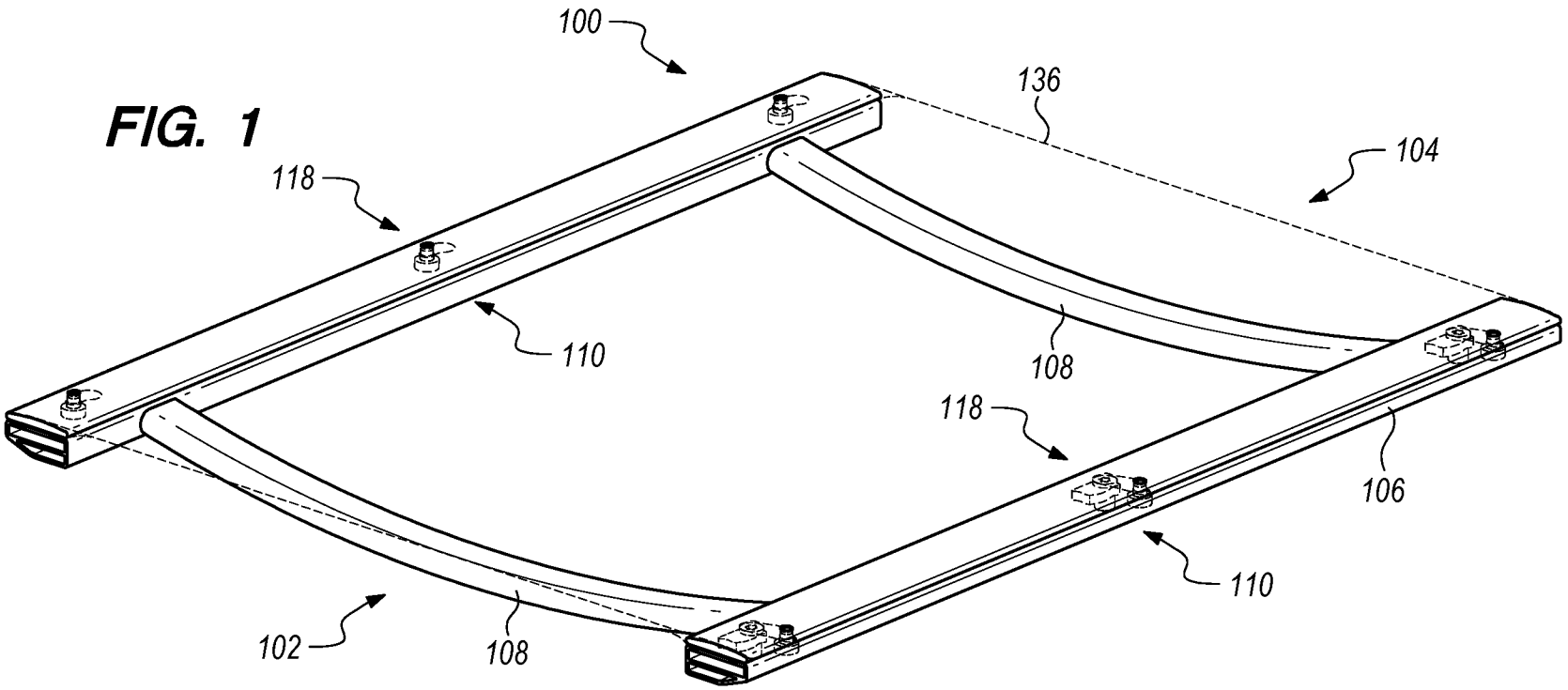
FIG. 1 illustrates a perspective view of an embodiment of a sling assembly disclosed herein, wherein the sling assembly is seen in its stretched, fully assembled position with the sling itself shown in dashed lines.

FIGS. 1-19 illustrate an embodiment of a sling assembly 100 disclosed herein. Turning first to FIG. 1, sling assembly 100 may be seen as generally comprising a chassis 102 and a sling frame 104 disposed thereupon. FIG. 1 particularly illustrates the sling assembly 100 in its stretched, fully assembled position.

Figure 2:
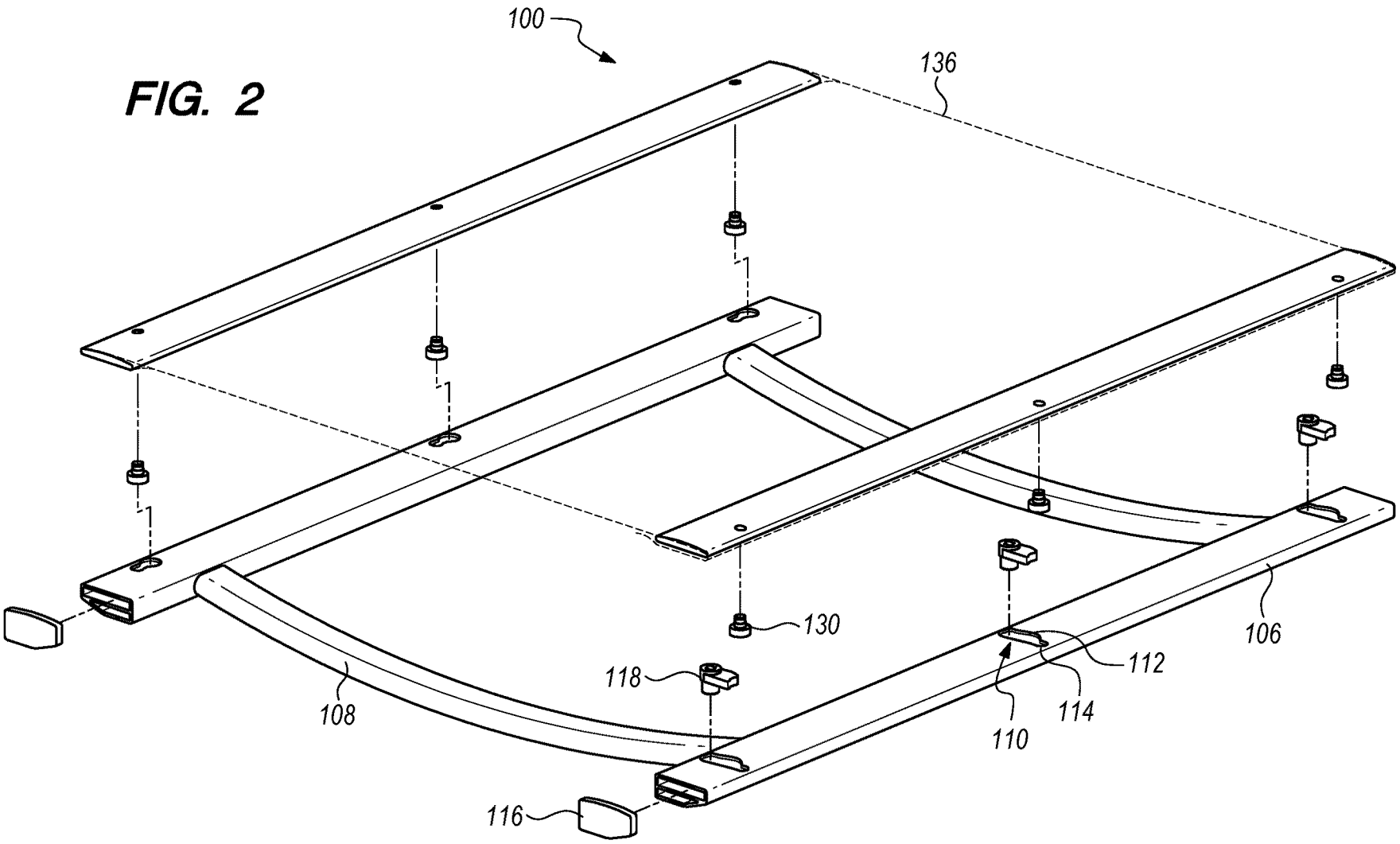
FIG. 2 is an exploded view of the sling assembly seen in FIG. 1 but with end caps, wherein the sling itself is shown in dashed lines and each cam lock is not yet inserted into its respective key hole.

FIG. 2 is an exploded view of the sling assembly 100 seen in FIG. 1. As seen here and elsewhere, chassis 102 is seen as preferably comprising first and second opposing rails 106 connected by first and second cross bars 108. However, the underlying configuration of chassis 102 need not comprise this particular structure or shape. For example, chassis 102 may be shaped more like a chaise lounge, chair, headrest, etc. Regardless of its shape, the components of the chassis 102, such as each rail 106 and cross bar 108, are preferably metal such as aluminum or stainless steel.

The chassis 102 provides support for the sling frame 104 and a means for anchoring the sling frame 104 thereupon. In this regard, the rails 106 of the chassis 102 include one or more key holes 110 cut therein. Each key hole 110 may comprise a channel 112 and a slot 114 at one end of the key hole 110 (closer to the outer edge of rail 106), as seen for example in FIG. 6. The end of each rail 106 may have an end cap 116, such as that seen in FIG. 2, which shows the sling assembly 100 in its pre-assembled state.

The sling frame 104 itself is generally comprised of first and second opposing stretch bars 128, which are preferably made of aluminum or stainless steel. A sling 136 connects each stretch bar 128, wherein the sling fabric may wrap around each stretch bar 128 in a sleeve-type configuration with the stretch bar 128 contained within each sleeve. Each such sleeve may be formed by stitching or thermal heat-bonding the sling fabric material. The sling fabric is preferably a stretchable, durable, breathable, and highly ultraviolet light resistant material. The shape of sling frame 104 may again vary from a chaise lounge, chair, headrest, etc. to match the underlying shape of the chassis 102.

Figure 14:
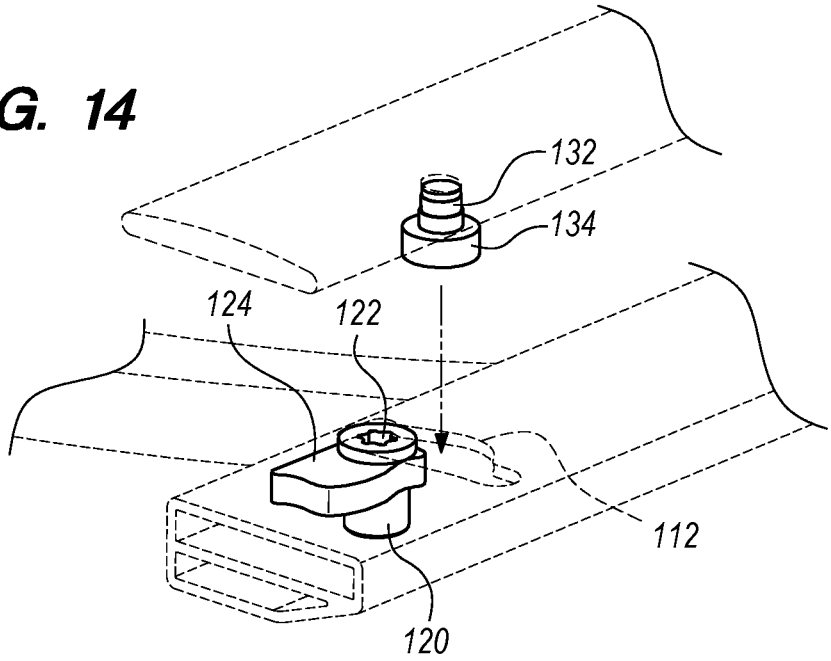
FIG. 14 illustrates the cam lock after it has been moved away from the central axis of the key hole but before the engagement member is also inserted into the key hole.

Each stretch bar 128 may have an engagement member 130 extending therefrom. The engagement member 130 may be threaded to be screwed into a corresponding hole of a stretch bar 128. Alternatively, the engagement member 130 may be permanently attached to the stretch bar 128. Each engagement member 130 preferably comprises a leg 132 and a glide base 134 extending therefrom, such as seen in FIG. 14. However, other structural arrangements of the engagement member 130 are possible.

Figure 11:
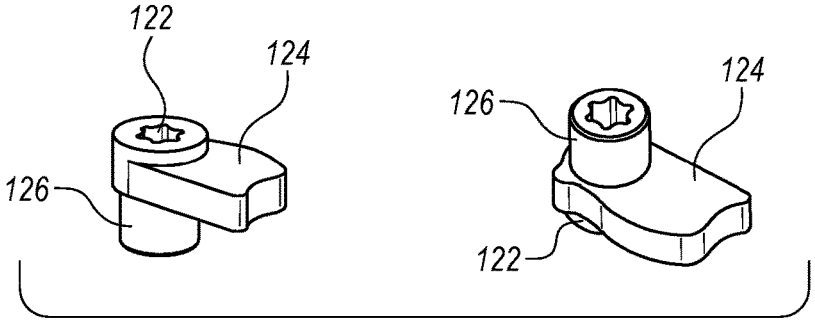
FIG. 11 shows details of the cam lock.

The sling assembly 100 also preferably comprises a cam lock 118. Turning to FIG. 11, the cam lock 118 may comprise a body 120, a keyway 122 cut therein, a cam 124 extending from the body 120, and a holder 126 disposed at the end of the cam lock 118 opposite the body 120. The keyway 122 is seen as having a hexagonal shape designed to fit a hex key; however, the shape of the keyway 122 may be configured to fit a simple "flat-blade" screwdriver, Phillips screwdriver, or the like. The shape of the holder 126 of the cam lock 118 may also vary but its shape is designed to match the shape of the engagement member 130 and particularly the glide base 134 upon which the holder 126 is configured to engage. Such engagement keeps the sling 136 taut when the sling assembly 100 is in its stretched, fully assembled position, as discussed next below.

Figure 3:
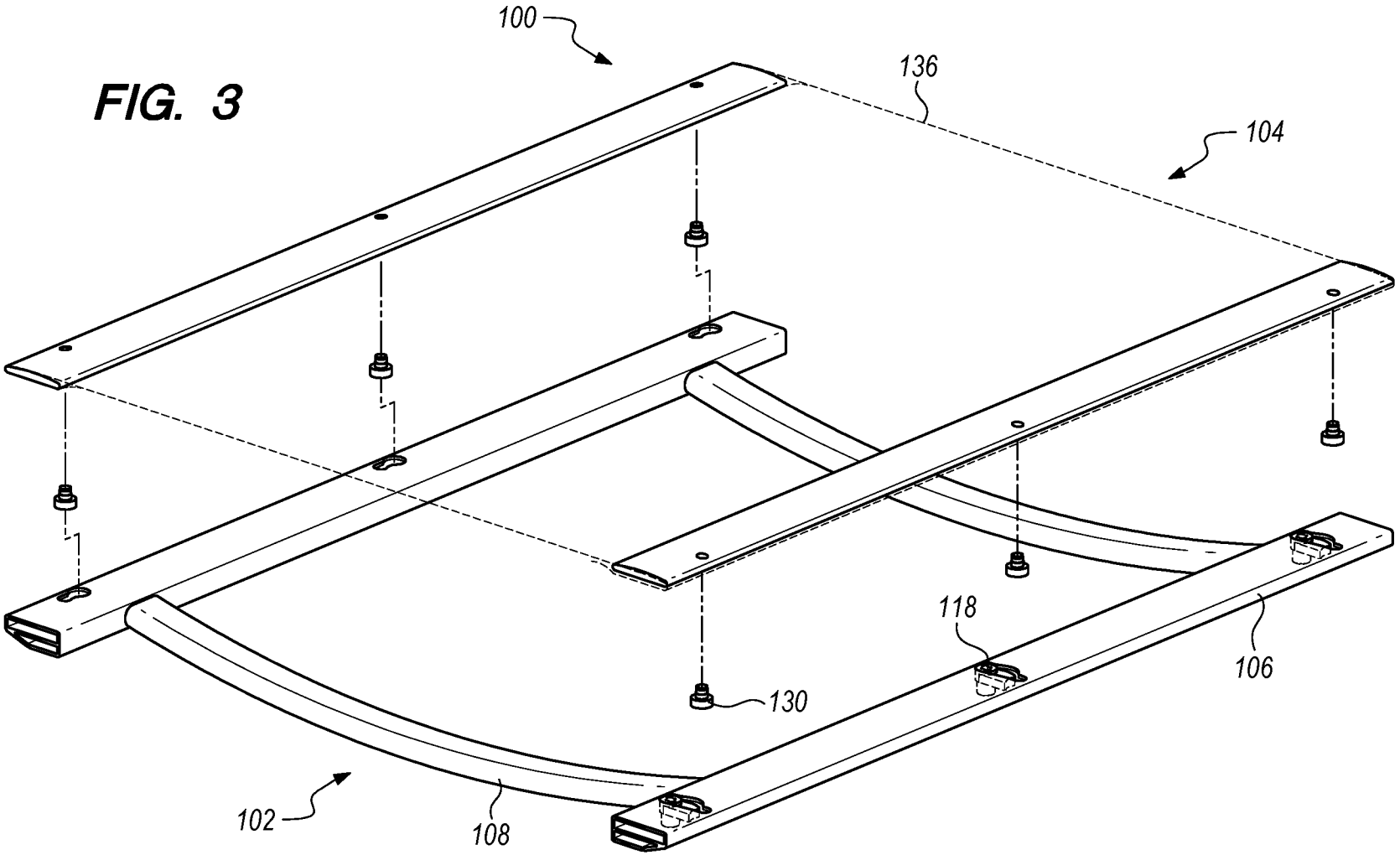
FIG. 3 is an exploded view of the sling assembly seen in FIG. 1, wherein the sling itself is shown in dashed lines and each cam lock is now inserted into its respective key hole, and wherein the sling assembly is in its pre-assembled position.
Figure 4:
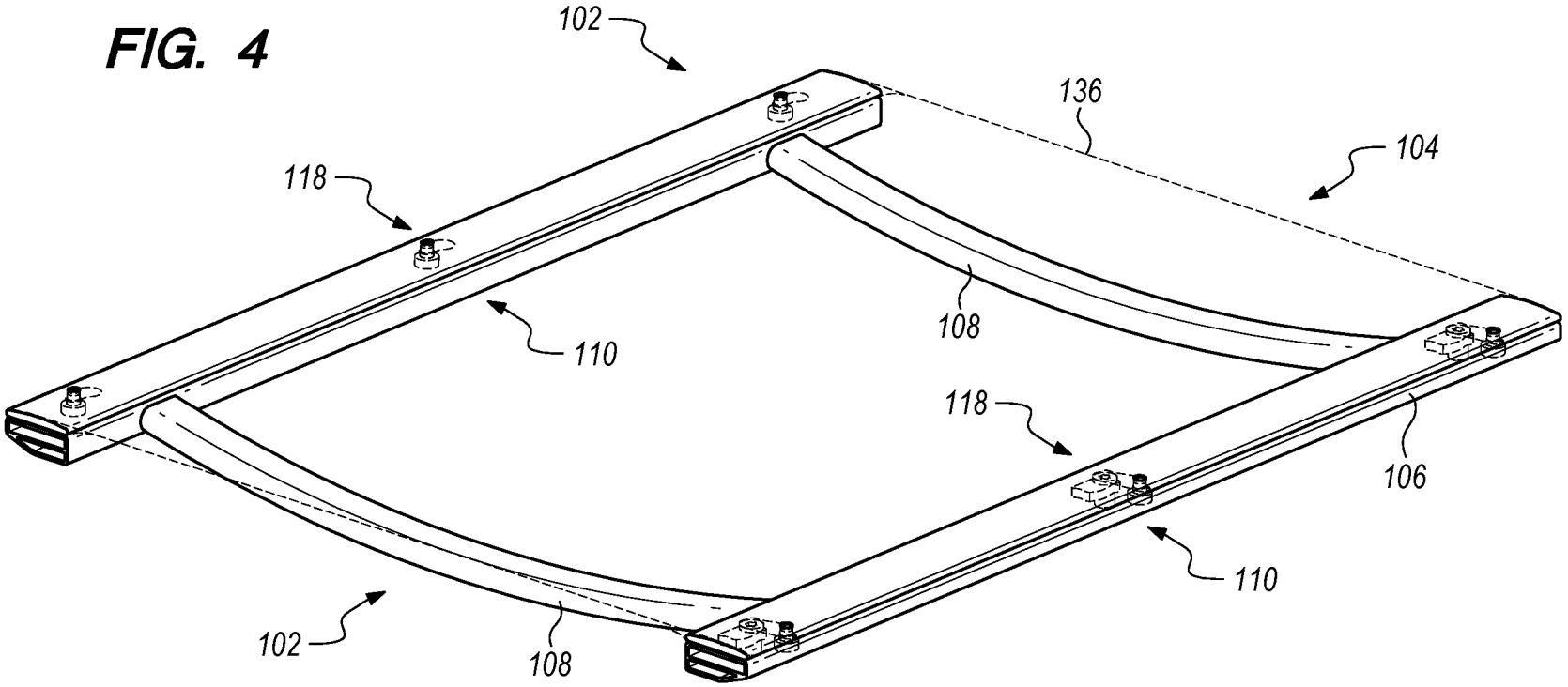
FIG. 4 illustrates the sling assembly seen in FIG. 1, but seen in its pre-assembled position wherein the dashed lines of the cam lock show the cam lock has been rotated away from the central axis of the key hole.
Figure 7:
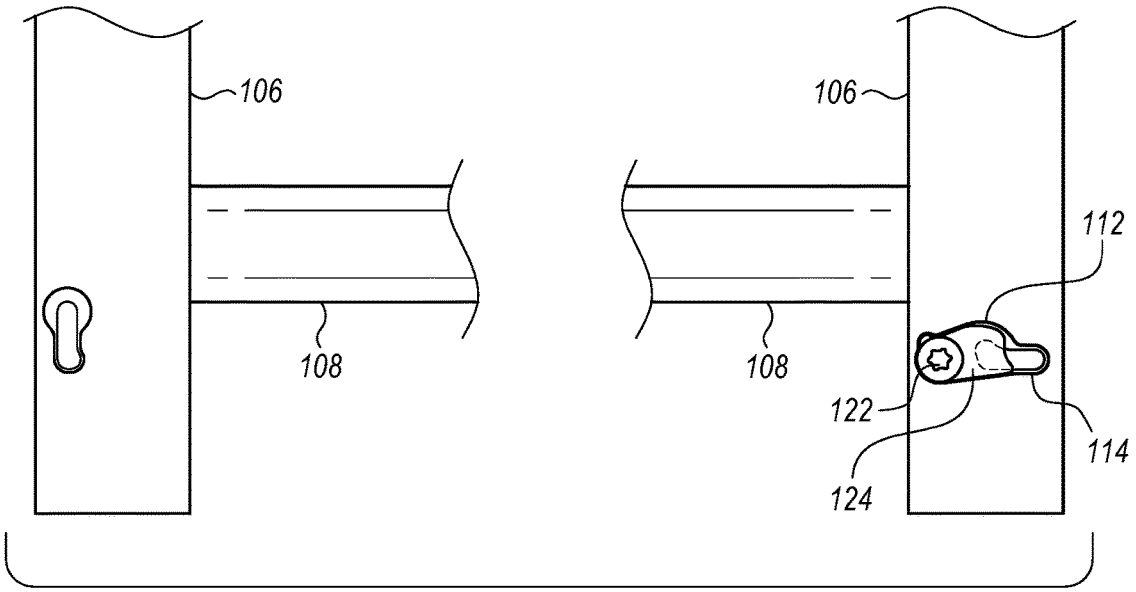
FIG. 7 illustrates a close-up, partial cut-away view of certain aspects of the sling assembly after the cam lock has been inserted into the key hole.
Figure 8:
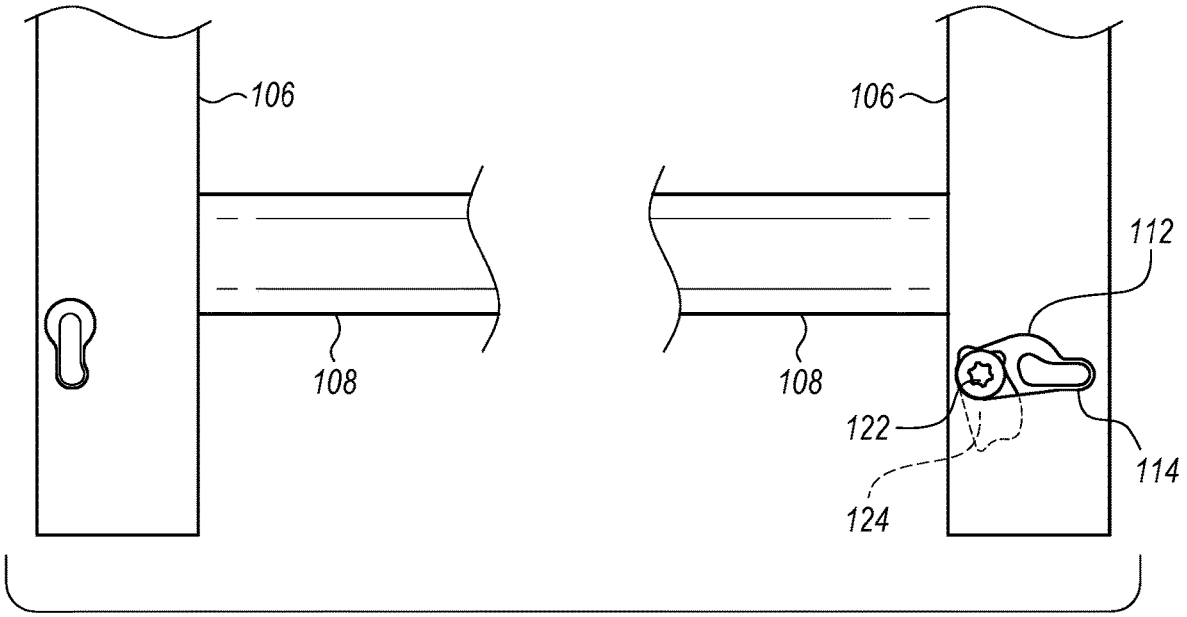
FIG. 8 illustrates a close-up, partial cut-away view of certain aspects of the sling assembly after the cam lock has been inserted into the key hole and then rotated away from the central axis of the key hole.
Figure 12:
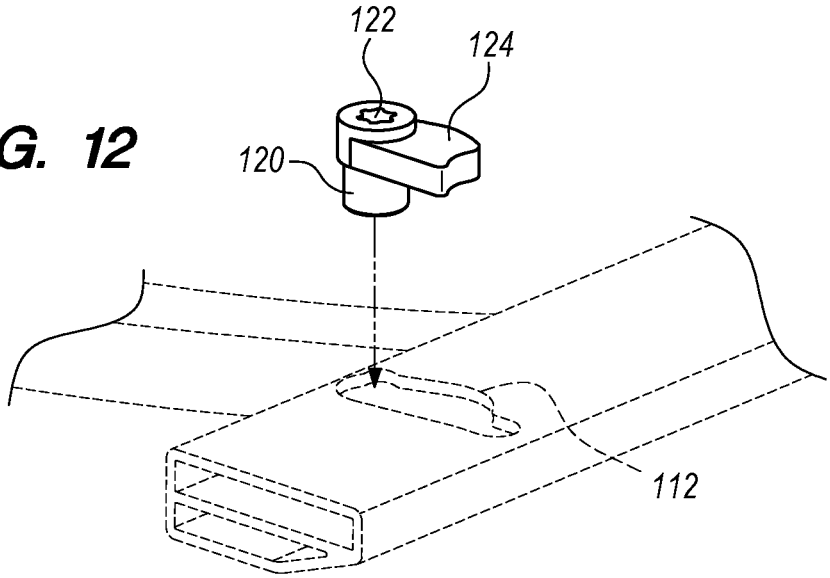
FIG. 12 shows the orientation of a cam lock before it is inserted into its respective key hole.
Figure 13:
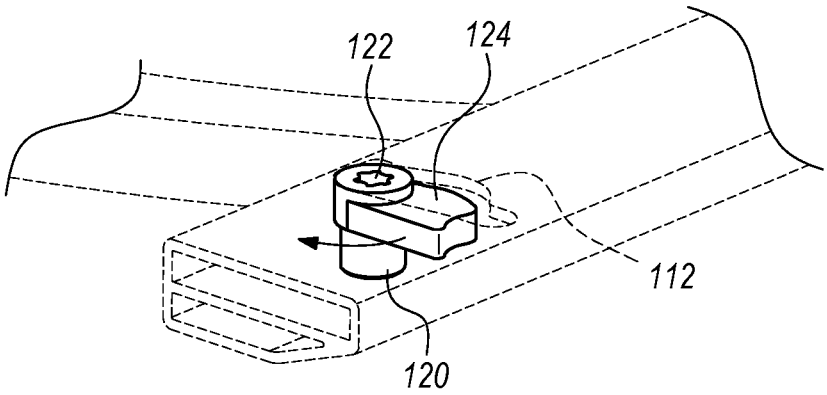
FIG. 13 illustrates the cam lock inserted into the key hole, wherein the body of the cam lock may be seen aligned with the central axis of the key hole, i.e., before the cam lock is rotated away from the central axis.
Figure 15:
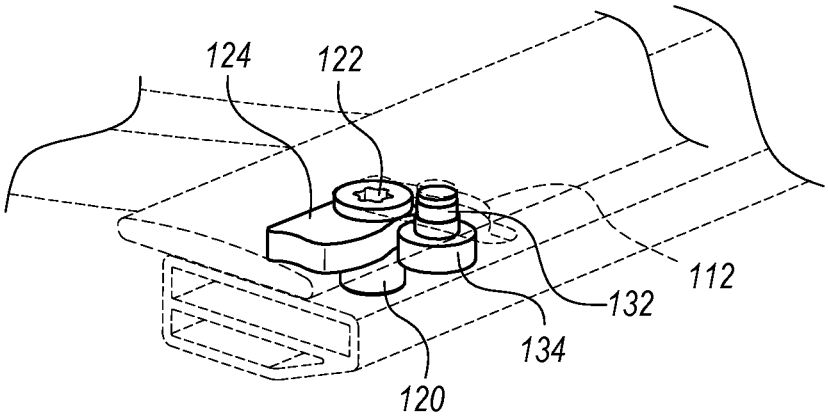
FIG. 15 illustrates the cam lock after it has been moved away from the central axis of the key hole and after the engagement member is inserted into the key hole.
Figure 16:
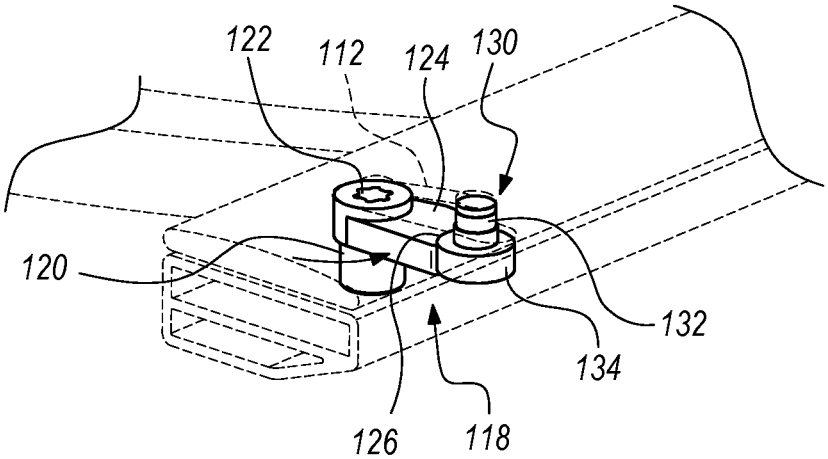
FIG. 16 shows how the cam lock engages the engagement member after the sling has been made taut to keep the taut sling in its fully assembly position.

In operation, the sling assembly 100 has been structurally arrangement as set forth above to enable a user to replace the sling 136 conveniently, quickly, and without the need for special tools. To elaborate, and with reference to FIGS. 2-3 and 7, the user inserts at least one cam lock 118 into a key hole 110 of a rail 106. To do so, the axis of the cam lock 118 is first aligned with the central axis of the key hole 110, as best seen in FIGS. 2 and 12. The body 120 of the cam lock 118 is then inserted into the channel 112 of the key hole 110, as seen in FIGS. 3, 7, and 13. Next, the cam lock 118 is rotated away from the central axis of the key hole 110, as seen in FIGS. 8-9 and 14-15. Rotation is done via the use of a standard tool, such as a hex key that fits into the keyway 122. FIGS. 4 and 14-15 illustrate the cam lock 118 may be rotated about 90° away from the central axis of the key hole 110.

Figure 17:
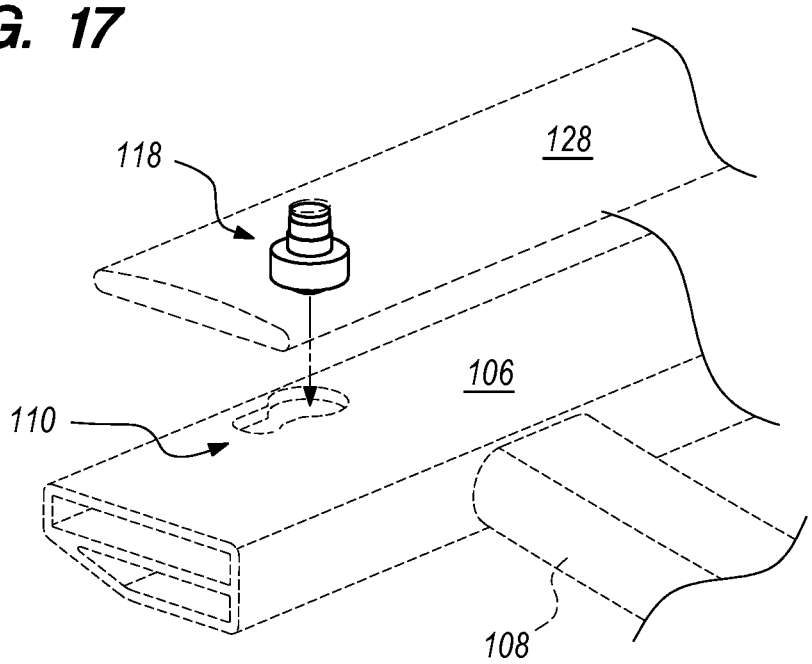
FIG. 17 illustrates one embodiment of a structural, anchor arrangement on the opposite side of the sling frame seen in FIGS. 6-16, wherein an engagement member is not yet inserted into a key hole of the rail.
Figure 18:
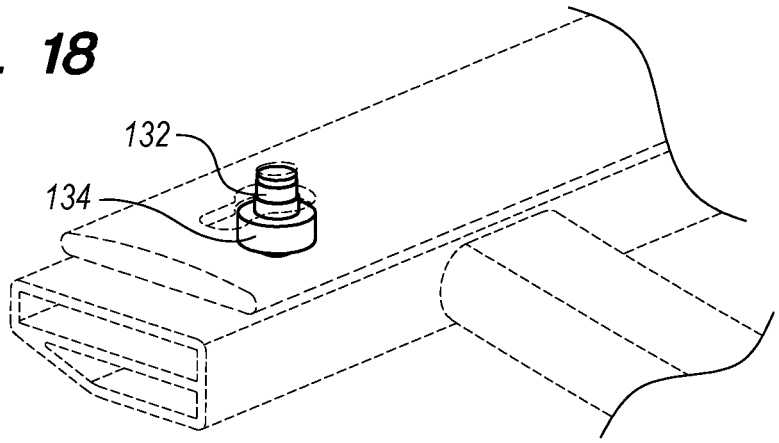
FIG. 18 shows the engagement member inserted into the key hole seen in FIG. 17.
Figure 19:
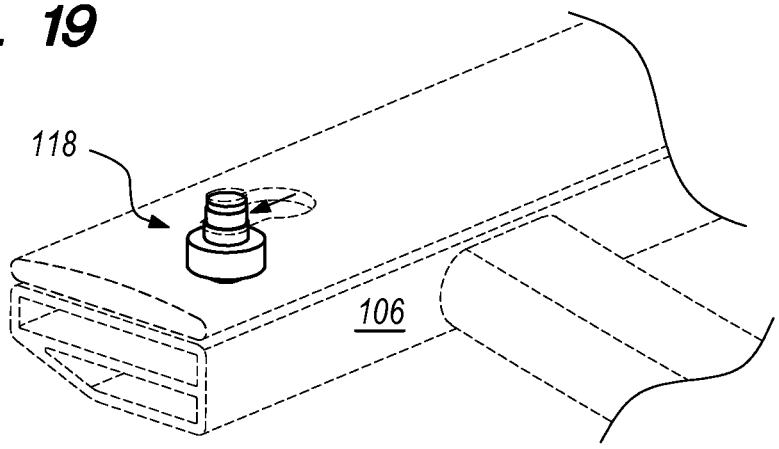
FIG. 19 shows the engagement member inserted into the key hole seen in FIG. 17, wherein the engagement member is now in its anchored position such that the sling may be made taut.

FIG. 4 also shows that each engagement member 130 on the left side of the sling frame 104 is inserted into a corresponding key hole 110 of the rail 106 on the left side of the chassis 102. As best seen in FIGS. 17-19, each engagement member 130 is first inserted into one end of the key hole 110 (see FIGS. 17-18) and then slid toward an end of a rail 106 until the leg 132 is seated against the end of the key hole 110 (see FIG. 19). In this manner, one side of the sling frame 104 is now anchored or held in place to permit the sling 136 to be made taut as disclosed immediately below. Other anchoring-type structures may be used instead of the disclosed engagement member and key hole arrangement.

Figure 5:
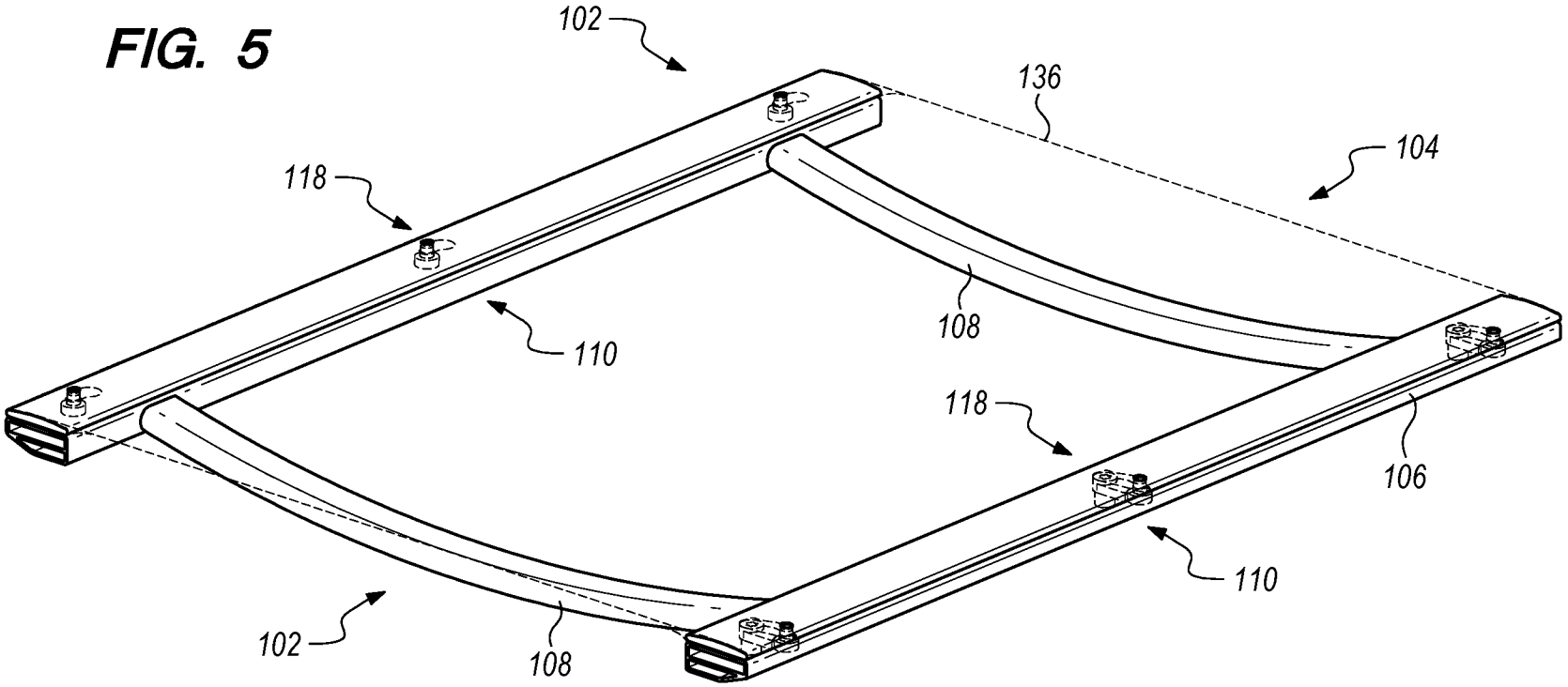
FIG. 5 illustrates the sling assembly seen in FIG. 1 in its fully assembled position wherein the dashed lines of the cam lock show the cam lock has been rotated back toward the central axis of the key hole (for the cam lock to engage the engagement member extending from the sling frame and thus keep the sling taut in its fully assembled state)
Figure 6:
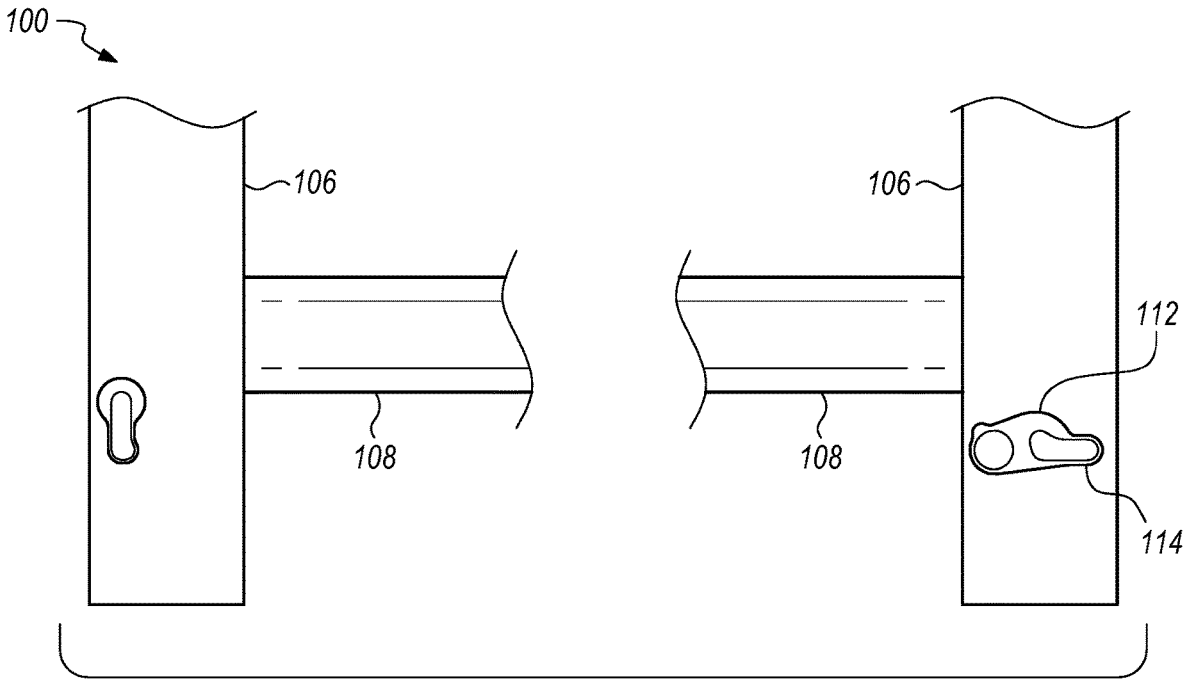
FIG. 6 illustrates a close-up, partial cut-away view of certain aspects of the sling assembly before a cam lock has been inserted into a key hole.
Figure 9:
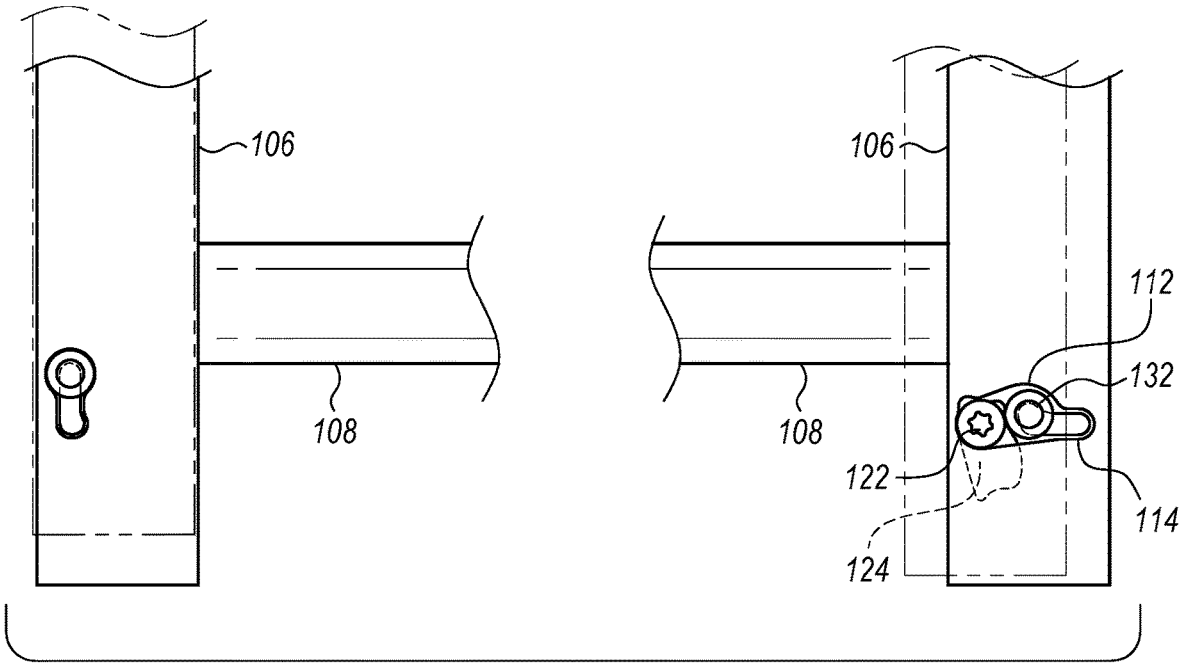
FIG. 9 illustrates a close-up, partial cut-away view of certain aspects of the sling assembly after the cam lock has been inserted into the key hole and rotated away from the central axis of the key hole, and after the engagement member has been inserted into the key hole, as would be seen in the sling assembly's pre-assembled position.
Figure 10:
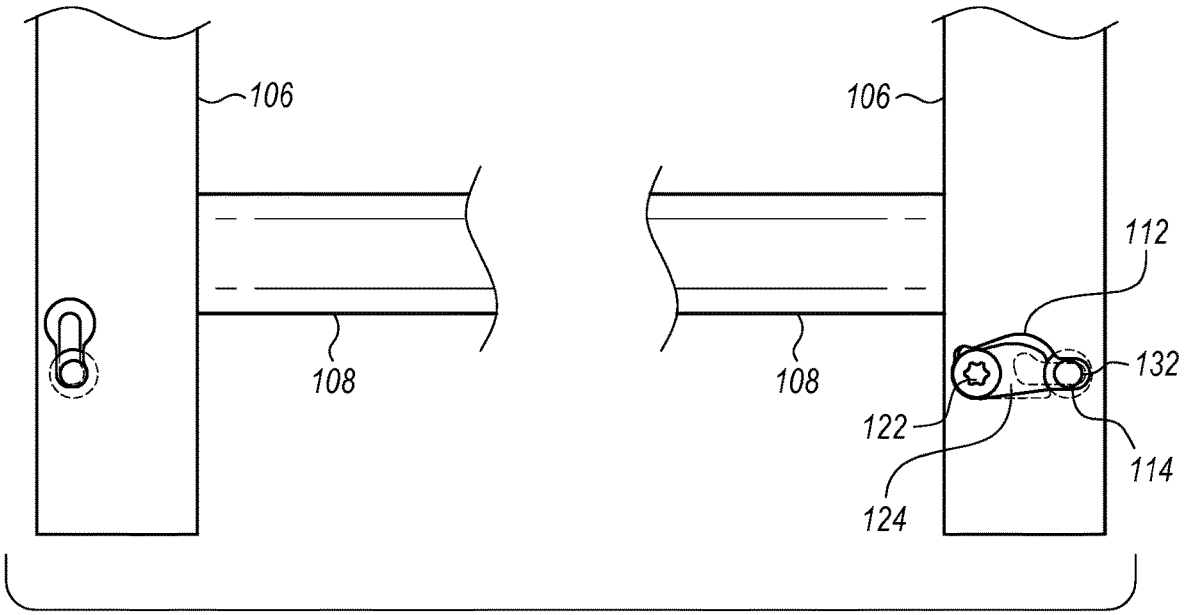
FIG. 10 illustrates a close-up, partial cut-away view of certain aspects of the sling assembly after the cam lock has been inserted into the key hole and rotated away from the central axis of the key hole, after the engagement member has been inserted into the key hole, and after the cam lock has been rotated back toward the central axis of the key hole to make the sling taut and keep the sling assembly in its taut, fully assembled position.

Next, each engagement member 130 on the right side of the sling frame 104 is inserted into a corresponding key hole 110 of the rail 106 on the right side of the chassis 102, as best seen in FIGS. 5, 9, and 14. In particular, the leg 132 and glide base 134 are inserted into the channel 112 of the respective key hole 110, as seen for example in FIG. 14. Once inserted, the cam lock 118 is then rotated back toward the central axis of the key hole 110 wherein holder 126 mates up against the glide base 134. Continued rotation moves the engagement member 130 away from the body 120 of the cam lock 118 (see FIGS. 9 and 15), along the central axis of the key hole 110 from the channel 112 to the slot 114, until the leg 132 abuts the end of the slot 114 (see FIGS. 10 and 16). Such an arrangement locks the sling frame 104, with its now-taut sling 136, in place against the chassis 102 to keep the sling assembly 100 in its stretched, fully assembled position. Over time, should the sling fabric material in this sling 136 become worn, aged, or saggy, the user may then simply reverse the above-disclosed method of operation to remove the old sling frame 104, and then repeat the methodology yet again to make sling fabric replacement convenient, quick, and without the need for special tools.

While certain embodiments have been described, the embodiments have been presented by way of example only and are not intended to limit the scope of the invention. Indeed, the novel sling assembly structure and corresponding method disclosed herein may be embodied in a variety of other forms. Furthermore, various omissions, substitutions, and changes in the form of the disclosed elements may be made without departing from the spirit of the invention.

The invention claimed is:

1. A chair assembly comprising:

a chassis having a first rail and an opposing second rail connected by a cross bar disposed therebetween;

a sling frame having a first stretch bar and an opposing second stretch bar connected by a stretchable fabric disposed therebetween; and a cam lock, wherein the first stretch bar has an engagement member extending therefrom, wherein the first rail has a key hole cut therein configured to receive the cam lock and the engagement member, and wherein the cam lock is adapted to engage the engagement member to stretch and hold the fabric in a stretched, fully assembled position.

2. The assembly of claim 1, wherein the cam lock has a body having a cam extending therefrom, wherein the body has a keyway, and wherein the cam has a holder.

3. The assembly of claim 2, wherein the engagement member has a leg and a glide base disposed at one end of the leg.

4. The assembly of claim 3, wherein the holder is configured to receive the glide base.

5. The assembly of claim 2, wherein the key hole has a channel and a slot in communication therewith, and wherein the channel is configured to receive the body of the cam lock.

6. The assembly of claim 1, wherein the key hole has a channel and a slot in communication therewith, wherein the engagement member has a leg and a glide base disposed at one end of the leg, and wherein the leg is disposed within the slot when the assembly is in the stretched, fully assembled position.

* * * * *